US011498108B2

(12) United States Patent
Nojiri et al.

(10) Patent No.: US 11,498,108 B2
(45) Date of Patent: Nov. 15, 2022

(54) MANUFACTURING APPARATUS AND MANUFACTURING METHOD FOR HAT-SHAPED CROSS-SECTION COMPONENT

(71) Applicant: TOYOTA JIDOSHA KABUSHIKI KAISHA, Toyota (JP)

(72) Inventors: Isao Nojiri, Nissin (JP); Naoya Sugimoto, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/877,602

(22) Filed: May 19, 2020

(65) Prior Publication Data

US 2021/0060634 A1 Mar. 4, 2021

(30) Foreign Application Priority Data

Sep. 2, 2019 (JP) ..... JP2019-159401

(51) Int. Cl.
*B21D 22/22* (2006.01)
*B21D 5/01* (2006.01)
*B21D 24/04* (2006.01)

(52) U.S. Cl.
CPC ..... *B21D 22/22* (2013.01); *B21D 5/01* (2013.01); *B21D 24/04* (2013.01)

(58) Field of Classification Search
CPC ..... B21D 24/16; B21D 22/20; B21D 22/22; B21D 22/26; B21D 22/02; B21D 22/06; B21D 22/10
USPC ..... 72/351
See application file for complete search history.

(56) References Cited

U.S. PATENT DOCUMENTS 10,695,814 B2 * 6/2020 Nitta ..... B21D 35/006 72/414
2010/0186476 A1 7/2010 Yamada
2013/0255349 A1 * 10/2013 Lee ..... B21D 22/26 72/414

(Continued)

FOREIGN PATENT DOCUMENTS

CN 103357736 A 10/2013
CN 104220182 A 12/2014

(Continued)

*Primary Examiner* — Adam J Eiseman
*Assistant Examiner* — Matthew Stephens
(74) *Attorney, Agent, or Firm* — Oblon, McClelland, Maier & Neustadt, L.L.P.

(57) ABSTRACT

A manufacturing apparatus for a hat-shaped cross-section component includes a die having first molding surfaces, a pad having a second molding surface, a punch having a third molding surface, a holder having fourth molding surfaces, and a first restraint portion. An upright wall is molded between a top and each of flanges by moving the pad and the punch relative to the die and the holder, or moving the die and the holder relative to the pad and the punch. The first restraint portion is configured to, during a period from when a top forming part is sandwiched by the second molding surface and the third molding surface to when the upright walls are molded, suppress displacement of the top forming part in a longitudinal direction of the top forming part relative to the second molding surface and the third molding surface.

12 Claims, 13 Drawing Sheets

(56) References Cited

U.S. PATENT DOCUMENTS

| | | | | |
|---|---|---|---|---|
| 2016/0221068 | A1* | 8/2016 | Tanaka | B21D 24/04 72/414 |
| 2016/0325330 | A1* | 11/2016 | Nitta | B21D 7/06 72/414 |
| 2017/0165735 | A1* | 6/2017 | Shinmiya | B21D 11/08 72/414 |
| 2018/0264534 | A1* | 9/2018 | Aso | B21D 22/30 72/414 |

FOREIGN PATENT DOCUMENTS

| | | | | |
|---|---|---|---|---|
| CN | 104690171 | A | 6/2015 | |
| CN | 107107148 | A | 8/2017 | |
| EP | 3 238 646 | A1 | 11/2017 | |
| JP | 11 -090552 | A | 4/1999 | |
| JP | 2001-252728 | A | 9/2001 | |
| JP | 2001252728 | A * | 9/2001 | B21D 37/12 |
| JP | 2009-241082 | A | 10/2009 | |
| WO | WO 2015/046023 | A1 | 4/2015 | |
| WO | 2016/104376 | A1 | 6/2016 | |

* cited by examiner

MANUFACTURING APPARATUS AND MANUFACTURING METHOD FOR HAT-SHAPED CROSS-SECTION COMPONENT

INCORPORATION BY REFERENCE

The disclosure of Japanese Patent Application No. 2019-159401 filed on Sep. 2, 2019 including the specification, drawings and abstract is incorporated herein by reference in its entirety.

BACKGROUND

1. Technical Field

The disclosure relates to a manufacturing apparatus and manufacturing method for a hat-shaped cross-section component (component having a hat shape in cross section).

2. Description of Related Art

When a hat-shaped cross-section component that is used as a frame member or other members for a vehicle is manufactured, a metal sheet workpiece is mostly pressed (drawn) into a hat shape in cross section by a manufacturing apparatus including a metal mold such as a die, a pad, a punch, and a holder.

More specifically, a manufacturing apparatus including a die having an opening that is open downward, a pad provided on the die so as to be forced into the opening against a downward urging force and relatively movable upward, a punch disposed to face the pad in an up-down direction, and a holder provided around the punch so as to face the die in the up-down direction and movable downward against an upward urging force is prepared. A workpiece is mounted on the holder and the punch, and the die and the pad are moved downward toward the holder and the punch for mold clamping. Then, the pad and the punch sandwiching a top forming part in the workpiece in the up-down direction and the die and the holder sandwiching flange forming parts in the workpiece in the up-down direction on both sides of the top forming part in a width direction relatively move in the up-down direction, and the punch enters into the opening of the die while pushing the pad upward. As a result, an upright wall is formed between a top and each flange.

However, this manufacturing apparatus has the following inconvenience. At the time of mold release (at the time of mold opening), when the die is moved upward, the punch moves out from the opening of the die, and, at the same time, the pad relatively moves downward by the urging force inside the opening of the die, while the holder moves upward by the urging force around the punch. Then, as the punch leaves from the lower surface of the top, the pressing force of the pad acts from the upper side on the top that has lost a support from the lower side by the punch, and the pressing force of the holder acts on the flanges from the lower side. Therefore, the hat-shaped cross-section component is compressed by the pressing force of the pad and the pressing force of the holder from both sides in the up-down direction, so the hat-shaped cross-section component may deform in such a mode that the upright walls buckle.

For example, WO2015/046023 describes a manufacturing apparatus. The manufacturing apparatus includes a holder-side restricting portion or a pad-side restricting portion. During mold release, the holder-side restricting portion fixes a blank holder to a punch by being attached to the punch so as to extend through the blank holder. During mold release, the pad-side restricting portion fixes a pad to a die by being attached to the pad so as to extend through the die. Thus, the manufacturing apparatus restricts the pressing force of the holder or the pad.

SUMMARY

However, with the manufacturing apparatus described in WO2015/046023, the restricting portion that limits a pressing force by restricting the movement of the holder relative to the punch or the movement of the pad relative to the die is provided in the manufacturing apparatus. For this reason, extensive processing equipment, or the like, is required, and a metal mold structure is complicated, so manufacturing cost increases.

The disclosure provides a technique for, when a hat-shaped cross-section component is manufactured, suppressing a deformation of the hat-shaped cross-section component during mold release with a simple configuration.

A manufacturing apparatus and manufacturing method for a hat-shaped cross-section component according to the disclosure make it difficult for a workpiece in itself or a hat-shaped cross-section component in itself to deform with a characteristic shape, or the like, of a metal mold.

A first aspect of the disclosure provides a manufacturing apparatus for a hat-shaped cross-section component. The manufacturing apparatus includes: a die having first molding surfaces on both sides in a width direction of a top forming part in a sheet workpiece, the first molding surfaces being oriented in a first pressing direction, the top forming part being to be a top after molding, the die having an opening between the first molding surfaces, the opening being open in the first pressing direction; a pad having a second molding surface oriented in the first pressing direction, the pad being provided in the die so as to be relatively movable in a second pressing direction and be pushed into the opening against an urging force in the first pressing direction from a position in which the second molding surface and the first molding surfaces are substantially flush with each other; a punch having a third molding surface oriented in the second pressing direction and facing the second molding surface; a holder having fourth molding surfaces oriented in the second pressing direction and facing the first molding surfaces, the holder being provided around the punch so as to be movable in the first pressing direction against an urging force in the second pressing direction from a position in which the fourth molding surfaces and the third molding surface are substantially flush with each other; and a first restraint portion. The pad and the punch are configured to sandwich and press the top forming part. The die and the holder are configured to sandwich and press flange forming parts in the workpiece on both sides in the width direction of the top forming part, the flange forming parts being to be flanges after molding. An upright wall is molded between the top and each flange by moving the pad and the punch in the second pressing direction relative to the die and the holder, or moving the die and the holder in the first pressing direction relative to the pad and the punch. The first restraint portion is configured to, during a period from when the top forming part is sandwiched by the second molding surface and the third molding surface to when the upright walls are molded, suppress displacement of the top forming part in a longitudinal direction of the top forming part relative to the second molding surface and the third molding surface.

Incidentally, when a hat-shaped cross-section component is manufactured, the reason why a relatively large pressing force of the pad is required is to suppress displacement (slide) of a top forming part in a longitudinal direction of the top forming part with a restraining force (hereinafter, also referred to as "pad restraining force") because a crack occurs in a top if displacement of the top forming part in the longitudinal direction occurs in a stretch flange forming process. For this reason, if displacement of the top forming part in the longitudinal direction is difficult to occur even without a relatively large pad restraining force, a relatively large pressing force of the pad should be not required.

According to the first aspect, since the first restraint portion for suppressing displacement of the top forming part in the longitudinal direction relative to the second and third molding surfaces is provided in a stretch flange forming process (during a period from when the top forming part is sandwiched by the second molding surface of the pad and the third molding surface of the punch to when the upright walls are molded), occurrence of a crack in the top can be reduced even with a relatively small pad restraining force. Therefore, a pad restraining force, in other word, an urging force that acts on the pad in the first pressing direction, can be relatively reduced. Hence, the pressing force of the pad, which acts on the top during mold release, can be relatively reduced, so a deformation of the hat-shaped cross-section component is suppressed with a simple configuration.

In the first aspect, the manufacturing apparatus may include a plurality of the first restraint portions, the first restraint portions may be contact portions respectively provided on both outer sides of the third molding surface in a longitudinal direction of the third molding surface in the punch, and the contact portions may be configured to come into contact with both ends of the top forming part in a longitudinal direction of the top forming part.

With the above configuration, both ends of the top forming part in the longitudinal direction come into contact with the contact portions respectively provided on both outer sides of the third molding surface in the longitudinal direction in the punch, in other words, both ends of the top forming part in the longitudinal direction are restrained, so there is no room for the top forming part to stretch in the longitudinal direction in the stretch flange forming process. As a result, no displacement of the top forming part in the longitudinal direction relative to the second and third molding surfaces occurs. Therefore, from the viewpoint of suppressing displacement of the top forming part in the longitudinal direction, a pad restraining force can be substantially zero, so a deformation of the hat-shaped cross-section component is suppressed during mold release with such a simple configuration that the contact portions are provided in the punch.

In the above aspect, the first restraint portion may be a ragged portion provided on at least one of the second molding surface and the third molding surface.

With the above configuration, when the top forming part is sandwiched by the second molding surface of the pad and the third molding surface of the punch, a surface (and/or back surface) of the top forming part is engaged with the ragged portion provided on at least one of the second and third molding surfaces. Therefore, the coefficient of friction between the second or third molding surface and the top forming part is increased. In other words, even when a pad restraining force is not relatively increased, displacement of the top forming part in the longitudinal direction is suppressed, and occurrence of a crack in the top is suppressed. Hence, the pad restraining force is relatively reduced, so a deformation of the hat-shaped cross-section component is suppressed during mold release with such a simple configuration that the ragged portion is provided on at least one of the second and third molding surfaces.

In the above aspect, an uneven portion may be provided in at least part of the top forming part, and manufacturing apparatus may include a plurality of the first restraint portions, the first restraint portions may be engaging portions provided on the second molding surface and the third molding surface and configured to engage with the uneven portion.

With the above configuration, when the engaging portions respectively provided on the second and third molding surfaces engage with the uneven portion provided in at least part of the top forming part, displacement of the top forming part in the longitudinal direction relative to the second and third molding surfaces is suppressed. Therefore, the pad restraining force is relatively reduced. As a result, a deformation of the hat-shaped cross-section component is suppressed during mold release.

Incidentally, the above-described manufacturing apparatus employs a technique for suppressing a deformation of the hat-shaped cross-section component during mold release by making a workpiece (top forming part) in itself difficult to deform in the longitudinal direction with a characteristic shape of the punch or pad and thus relatively reducing the pad restraining force (the pressing force of the pad); however, a technique is not limited thereto. The hat-shaped cross-section component in itself may be made difficult to deform during mold release.

A second aspect of the disclosure provides a manufacturing apparatus for a hat-shaped cross-section component. The manufacturing apparatus includes: a die having first molding surfaces on both sides in a width direction of a top forming part in a sheet workpiece, the first molding surfaces being oriented in a first pressing direction, the top forming part being to be a top after molding, the die having an opening between the first molding surfaces, the opening being open in the first pressing direction; a pad having a second molding surface oriented in the first pressing direction, the pad being provided in the die so as to be relatively movable in a second pressing direction and be pushed into the opening against an urging force in the first pressing direction from a position in which the second molding surface and the first molding surfaces are substantially flush with each other; a punch having a third molding surface oriented in the second pressing direction and facing the second molding surface; a holder having fourth molding surfaces oriented in the second pressing direction and facing the first molding surfaces, the holder being provided around the punch so as to be movable in the first pressing direction against an urging force in the second pressing direction from a position in which the fourth molding surfaces and the third molding surface are substantially flush with each other; and a second restraint portion. The pad and the punch are configured to sandwich and press the top forming part. The die and the holder are configured to sandwich and press flange forming parts in the workpiece on both sides in the width direction of the top forming part, the flange forming parts being to be flanges after molding. An upright wall is molded between the top and each flange by moving the pad and the punch in the second pressing direction relative to the die and the holder, or moving the die and the holder in the first pressing direction relative to the pad and the punch. The second restraint portion is configured to, during a period when the die and the holder sandwiching the flanges are being moved in the second pressing direction to be released while the second molding surface is in contact with the top, suppress spreading of the upright walls and the flanges in the width direction.

According to the second aspect of the disclosure, spreading of the upright walls and flanges in the width direction is suppressed by the second restraint portion, so a hat-shaped cross section is maintained, in other words, the upright walls are maintained straight. Therefore, a warpage (curve) is made difficult to occur. Hence, even when the pressing force of the pad, which generates a pad restraining force to suppress displacement of the top forming part in the longitudinal direction, acts on the top during mold release, a deformation of the hat-shaped cross-section component is suppressed with such a simple configuration that spreading of the upright walls and flanges in the width direction is suppressed by the second restraint portion.

In the second aspect, the manufacturing apparatus include a plurality of the second restraint portions, the second restraint portions may be contact members projecting from the first molding surfaces or the fourth molding surfaces by a thickness of the flanges and configured to come into contact with both end portions of the flanges in a width direction of the flanges.

With the above configuration, both end portions of the flanges in the width direction come into contact with the contact members projecting from the first or fourth molding surfaces, so spreading of the upright walls and flanges is suppressed. In addition, the contact members project by the thickness of the flanges, so the flanges can be sandwiched by the first molding surfaces of the die and the fourth molding surfaces of the holder as in the case where no such contact members are provided. Hence, with such a simple configuration that the contact members are provided on the first or fourth molding surfaces, spreading of the upright walls and flanges in the width direction is suppressed, and a deformation of the hat-shaped cross-section component is suppressed during mold release, without impairing the function to sandwich the flanges.

The disclosure is also applicable to a manufacturing method for a hat-shaped cross-section component.

A third aspect of the disclosure provides a manufacturing method for a hat-shaped cross-section component in a manufacturing apparatus. The manufacturing apparatus includes: a die having first molding surfaces on both sides in a width direction of a top forming part in a sheet workpiece, the first molding surfaces being oriented in a first pressing direction, the top forming part being to be a top after molding, the die having an opening between the first molding surfaces, the opening being open in the first pressing direction; a pad having a second molding surface oriented in the first pressing direction, the pad being provided in the die so as to be relatively movable in a second pressing direction and be pushed into the opening against an urging force in the first pressing direction from a position in which the second molding surface and the first molding surfaces are substantially flush with each other; a punch having a third molding surface oriented in the second pressing direction and facing the second molding surface; and a holder having fourth molding surfaces oriented in the second pressing direction and facing the first molding surfaces, the holder being provided around the punch so as to be movable in the first pressing direction against an urging force in the second pressing direction from a position in which the fourth molding surfaces and the third molding surface are substantially flush with each other. The manufacturing method includes a mold clamping step of molding an upright wall between the top and each of flanges by moving the second molding surface and the third molding surface, which sandwich and press the top forming part, in the second pressing direction relative to the first molding surfaces and the fourth molding surfaces, which sandwich and press flange forming parts to be the flanges after molding in the workpiece on both sides of the top forming part in the width direction of the top forming part, or moving the first molding surfaces and the fourth molding surfaces relative to the second molding surface and the third molding surface, in the first pressing direction. In the mold clamping step, while displacement of the top forming part in a longitudinal direction of the top forming part relative to the second molding surface and the third molding surface is suppressed, the second molding surface and the third molding surface are relatively moved in the second pressing direction and the first molding surfaces and the fourth molding surfaces are relatively moved in the first pressing direction.

According to the third aspect, as in the case of the manufacturing apparatus, the pressing force of the pad caused by the urging force, which acts on the top during mold release, can be relatively reduced, so a deformation of the hat-shaped cross-section component is suppressed with a simple configuration.

In the third aspect, in the mold clamping step, both ends of the top forming part in the longitudinal direction may be brought into contact with contact portions respectively provided on both outer sides of the third molding surface in a longitudinal direction of the third molding surface in the punch.

With the above configuration, with such a simple configuration that both ends of the top forming part in the longitudinal direction are brought into contact with the contact portions provided in the punch, the pressing force of the pad is relatively reduced, so a deformation of the hat-shaped cross-section component is suppressed during mold release.

In the above aspect, in the mold clamping step, the top forming part may be engaged with a ragged portion provided on at least one of the second molding surface and the third molding surface.

With the above configuration, with such a simple configuration that the top forming part is engaged with the ragged portion provided on at least one of the second molding surface and the third molding surface, the pressing force of the pad is relatively reduced, so a deformation of the hat-shaped cross-section component is suppressed during mold release.

In the above aspect, the manufacturing method may further include a preparation step of, before the mold clamping step, providing an uneven portion in at least part of the top forming part. In the mold clamping step, a pair of engaging portions respectively provided on the second molding surface and the third molding surface may be engaged with the uneven portion.

With the above configuration, with such a simple configuration that the engaging portions respectively provided on the second molding surface and the third molding surface are engaged with the uneven portion provided in the preparation step, the pressing force of the pad is relatively reduced, so a deformation of the hat-shaped cross-section component during mold release is suppressed.

A fourth aspect of the disclosure provides a manufacturing method for a hat-shaped cross-section component in a manufacturing apparatus. The manufacturing apparatus includes: a die having first molding surfaces on both sides in a width direction of a top forming part in a sheet workpiece, the first molding surfaces being oriented in a first pressing direction, the top forming part being to be a top after molding, the die having an opening between the first molding surfaces, the opening being open in the first pressing direction; a pad having a second molding surface oriented in the first pressing direction, the pad being provided in the die so as to be relatively movable in a second pressing direction and be pushed into the opening against an urging force in the first pressing direction from a position in which the second molding surface and the first molding surfaces are substantially flush with each other; a punch having a third molding surface oriented in the second pressing direction and facing the second molding surface; and a holder having fourth molding surfaces oriented in the second pressing direction and facing the first molding surfaces, the holder being provided around the punch so as to be movable in the first pressing direction against an urging force in the second pressing direction from a position in which the fourth molding surfaces and the third molding surface are substantially flush with each other. The manufacturing method includes: a mold clamping step of molding an upright wall between the top and each of flanges by moving the second molding surface and the third molding surface, which sandwich and press the top forming part, in the second pressing direction relative to the first molding surfaces and the fourth molding surfaces, which sandwich and press flange forming parts to be the flanges after molding in the workpiece on both sides of the top forming part in the width direction of the top forming part, or moving the first molding surfaces and the fourth molding surfaces relative to the second molding surface and the third molding surface in the first pressing direction; and a mold opening step of, after the mold clamping step, moving the die and the holder sandwiching the flanges in the second pressing direction to be released while the second molding surface is in contact with the top. In the mold opening step, the die and the holder are moved in the second pressing direction while spreading of the upright walls and the flanges in a width direction is suppressed.

According to the fourth aspect, as in the case of the manufacturing apparatus, a deformation of the hat-shaped cross-section component during mold release is suppressed with such a simple configuration that mold release is performed while spreading of the upright walls and flanges in the width direction is suppressed.

In the fourth aspect, in the mold clamping step, both end portions of the flanges in a width direction of the flanges may be brought into contact with contact members projecting from the first molding surface or the fourth molding surface by a thickness of the flanges.

With the above configuration, with such a simple configuration that both end portions of the flanges in the width direction are brought into contact with the contact members provided on the first molding surfaces or the fourth molding surfaces, spreading of the upright walls and flanges in the width direction is suppressed, and a deformation of the hat-shaped cross-section component is suppressed.

In the above aspect, the hat-shaped cross-section component may have a convex curve curved in a longitudinal direction of the hat-shaped cross-section component and protruding in the second pressing direction.

With the above configuration, when the hat-shaped cross-section component has a convex curve, a crack easily occurs in the top in a stretch flange forming process, so a relatively large pad restraining force is required. However, the manufacturing apparatus and manufacturing method of the disclosure, which are able to suppress a deformation of a hat-shaped cross-section component during mold release by reducing a pad restraining force or maintaining a pad-shaped cross section, are suitably applicable to a hat-shaped cross-section component having a convex curve.

In the above aspect, the workpiece may be made of a high-tensile steel.

With the above configuration, a pad restraining force for suppressing occurrence of a crack in the top in the stretch flange forming process increases in proportion to the strength and thickness of the raw material of a work. However, the manufacturing apparatus and manufacturing method of the disclosure, which are able to suppress a deformation of a hat-shaped cross-section component during mold release by reducing a pad restraining force or maintaining a pad-shaped cross section, are suitably applicable to a workpiece made of a high-tensile steel.

As described above, according to the aspects of the disclosure, a deformation of a hat-shaped cross-section component is suppressed during mold release with a simple configuration.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, embodiments of the disclosure will be described with reference to the accompanying drawings.

First Embodiment

Figure 1:
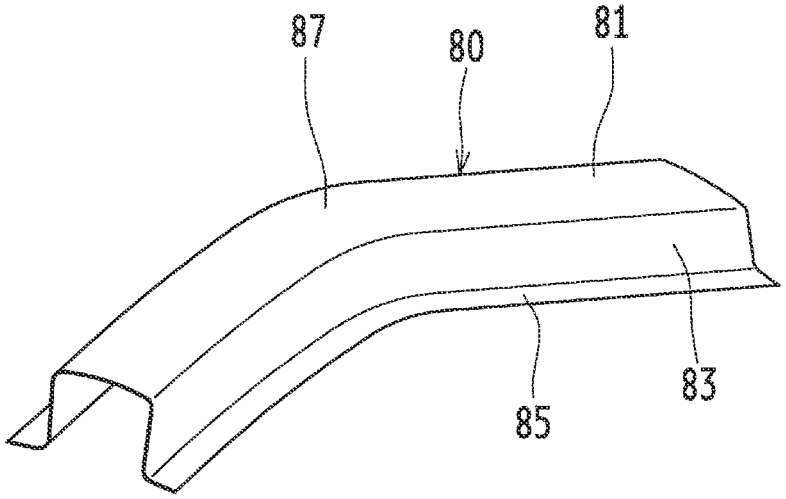
FIG. 1 is a perspective view that schematically shows a hat-shaped cross-section component that is manufactured with a manufacturing apparatus and manufacturing method according to a first embodiment of the disclosure.

FIG. 1 is a perspective view that schematically shows a hat-shaped cross-section component 80 that is manufactured by a manufacturing apparatus and manufacturing method according to the present embodiment. The hat-shaped cross-section component 80 is manufactured by pressing (drawing) a sheet workpiece 70 (see FIG. 2) made of a high-tensile steel (high-tensile material) having, for example, a tensile strength of higher than or equal to 490 MPa (desirably, higher than or equal to 980 MPa) with a manufacturing apparatus 1 (described later).

As shown in FIG. 1, the hat-shaped cross-section component 80 has a top 81, a pair of upright walls 83, and a pair of flanges 85. The top 81 has a convex curve 87 curved in a longitudinal direction and protruding upward. The upright walls 83 extend vertically downward from both end portions in a width direction (a direction perpendicular to the longitudinal direction) of the top 81. The flanges 85 extend outward in the width direction from lower end portions of the upright walls 83. The hat-shaped cross-section component 80 has a hat shape in cross section and is open downward and curves in a substantially inverted V-shape along the longitudinal direction as a whole. The hat-shaped cross-section component 80 and a hat-shaped cross-section component (not shown) that is open upward on the contrary make up a long member with closed section when the pairs of flanges 85 are joined by spot welding, or the like. The long member with closed section is used as, for example, a frame member for vehicles, such as a front side member. Hereinafter, the manufacturing apparatus 1 and manufacturing method for such a hat-shaped cross-section component 80 according to the present embodiment will be described in detail with reference to the accompanying drawings.

Basic Configuration of Manufacturing Apparatus

FIG. 2 to FIG. 6 are cross-sectional views that schematically illustrate manufacturing steps 1 to 5 for a hat-shaped cross-section component 80. In FIG. 2 to FIG. 6, for the sake of visualization, only die pieces 13, a pad 20, a punch 30, a holder 40, the workpiece 70, and the hat-shaped cross-section component 80 are hatched in the cross sectional views.

Figure 2:
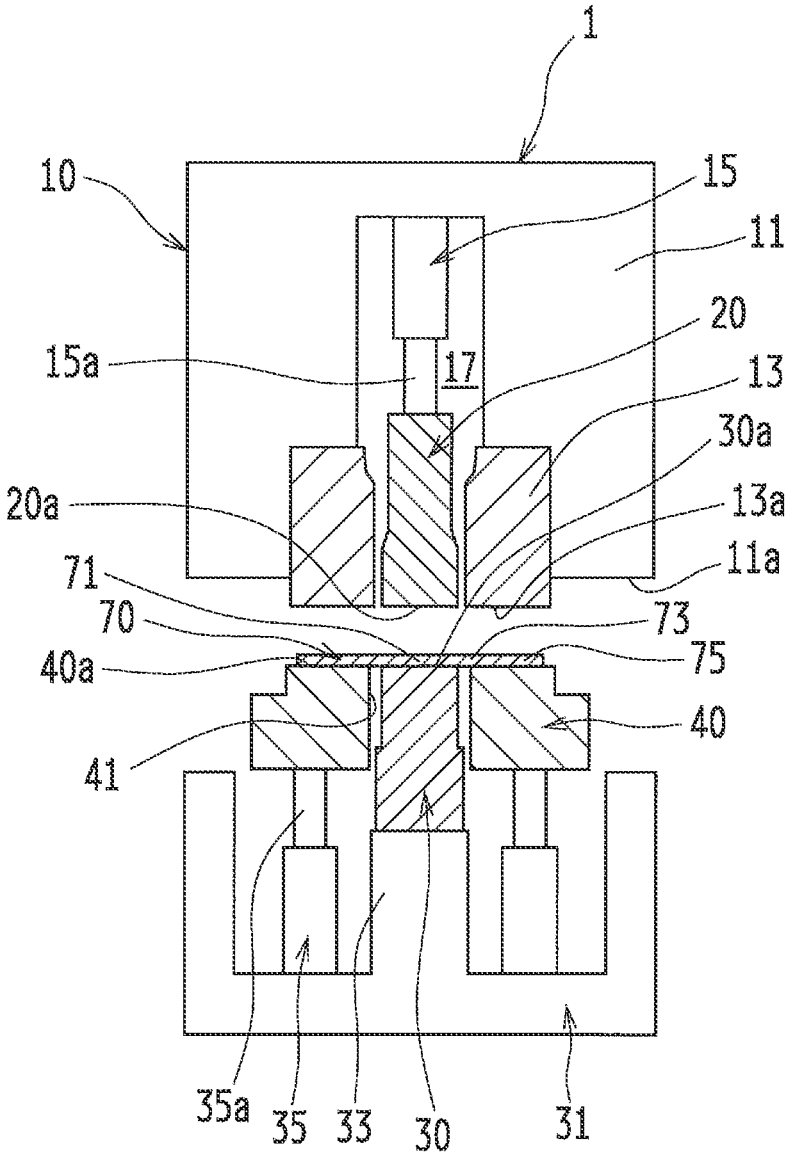
FIG. 2 is a cross-sectional view that schematically illustrates manufacturing step 1 for a hat-shaped cross-section component.

As shown in FIG. 2, and the like, the manufacturing apparatus 1 includes a die 10, the pad 20, the punch 30, and the holder 40. As shown in FIG. 2, the manufacturing apparatus 1 manufactures the hat-shaped cross-section component 80 by pressing the sheet workpiece 70 mounted on the punch 30 and the holder 40.

The die 10 has a pair of downward-oriented first molding surfaces 13*a* (oriented in a first pressing direction) at both sides in the width direction, and has an opening 17 between the first molding surfaces 13*a*. The opening 17 is open downward (in the first pressing direction).

More specifically, the die 10 has a substantially rectangular parallelepiped shape as a whole. The die 10 is fixed to a slide of a pressing machine (not shown). The die 10 has the opening 17 that is open downward. In other words, the die 10 has a substantially box shape that is open downward. As shown in FIG. 2, and the like, the die 10 includes a die main body 11, the die pieces 13, and a plurality of nitrogen gas cylinders 15.

Although not shown in FIG. 2 to FIG. 6, a lower end surface 11*a* of the die main body 11 curves in a substantially inverted V-shape along the longitudinal direction (curves in the longitudinal direction and concaved upward). The die pieces 13 are attached to a lower end portion of the die main body 11. As shown in FIG. 2, lower end surfaces 13*a* of the die pieces 13 project downward from the lower end surface 11*a* of the die main body 11. The lower end surfaces 13*a* of the die pieces 13 curve in a substantially inverted V-shape along the longitudinal direction and make up a pair of first molding surfaces 13*a* that press flange forming parts 75 (parts to be flanges 85 after molding) located at both side portions of the workpiece 70 at the time of pressing. As shown in FIG. 2, and the like, the nitrogen gas cylinders 15 are connected to a top surface of the opening 17, and a rod 15*a* of each nitrogen gas cylinder 15 constantly protrudes downward under the pressure of nitrogen gas. Instead of the nitrogen gas cylinders 15, an elastic member by which the rod 15*a* is constantly urged downward, may be provided.

The pad 20 has a downward-oriented second molding surface 20*a*. The pad 20 is provided in the die 10 so as to be relatively movable upward (in a second pressing direction) and pushed into the opening 17 against a downward urging force from a position in which the second molding surface 20*a* and the first molding surfaces 13*a* are substantially flush with each other.

More specifically, the pad 20 has a substantially rectangular parallelepiped shape. As shown in FIG. 2, and the like, the pad 20 is provided in the opening 17 of the die 10, and an upper end of the pad 20 is connected to lower ends of the rods 15*a* of the nitrogen gas cylinders 15. Thus, the pad 20 is constantly urged downward by the nitrogen gas cylinders 15 and is configured to, when a force pushing the pad 20 upward is applied, be able to move upward relative to the die 10 against the urging force of the nitrogen gas cylinders 15.

A lower surface 20*a* of the pad 20 curves in a substantially inverted V-shape along the longitudinal direction (curves in the longitudinal direction and concaved upward) and makes up the second molding surface 20*a* that presses a top forming part 71 (a part to be a top 81 after molding) located at a center of the workpiece 70 at the time of pressing. The pad 20 is disposed in the opening 17 such that the second molding surface 20*a* and the first molding surfaces 13*a* are flash with each other as shown in FIG. 2 in a position in which the pad 20 is lowered the most (the rods 15*a* are fully extended) by the downward urging of the nitrogen gas cylinders 15.

The punch 30 has an upward-oriented third molding surface 30*a* (oriented in the second pressing direction) facing the second molding surface 20*a*.

More specifically, as shown in FIG. 2, and the like, the punch 30 is connected to a drag 31 fixed to a bolster of the pressing machine. The drag 31 has a substantially box shape that is open upward and has a punch holder 33 extending upward at a center of the drag 31. The punch 30 is disposed in a position in which an upper surface 30*a* of the punch 30 and the second molding surface 20*a* of the pad 20 face in an up-down direction when the punch 30 is attached to an upper end portion of the punch holder 33. The upper surface 30*a* of the punch 30 curves in a substantially inverted V-shape along the longitudinal direction (curves in the longitudinal direction and protrudes upward) as in the case of the second molding surface 20*a* of the pad 20 and makes up the third molding surface 30*a* that presses the top forming part 71 of the workpiece 70 at the time of pressing.

The holder 40 has upward-oriented fourth molding surfaces 40*a* facing the first molding surfaces 13*a*. The holder 40 is provided around the punch 30 so as to be movable downward against an upward urging force from a position in which the fourth molding surfaces 40*a* and the third molding surface 30*a* are flush with each other.

More specifically, the holder 40 has an opening 41 extending through in the up-down direction over the overall length in the longitudinal direction at the center in the width direction. Thus, the holder 40 has a substantially rectangular ring shape. Upper surfaces 40*a* of the holder 40 curve in a substantially inverted V-shape along the longitudinal direction (curve in the longitudinal direction and protrude upward) as in the case of the first molding surfaces 13*a* of the die pieces 13 and make up the fourth molding surfaces 40*a* that press the flange forming parts 75 of the workpiece 70 at the time of pressing.

When the thus configured holder 40 is disposed on the drag 31 such that the punch 30 is inserted in the opening 41, the holder 40 is located around the punch 30. As shown in FIG. 2, and the like, a plurality of nitrogen gas cylinders 35 is provided around the punch holder 33 in the drag 31, and a rod 35*a* of each nitrogen gas cylinder 35 constantly protrudes upward under the pressure of nitrogen gas. A lower end of the holder 40 is connected to upper ends of the rods 35*a* of the nitrogen gas cylinders 35. Thus, the holder 40 is constantly urged upward by the nitrogen gas cylinders 35 and is configured to, when a force pushing the holder 40 downward is applied, be able to move downward against the urging force of the nitrogen gas cylinders 35. The holder 40 is disposed on the drag 31 such that the fourth molding surfaces 40*a* of the holder 40 and the third molding surface 30*a* of the punch 30 are flush with each other in a position in which the holder 40 is raised the most (the rods 35*a* are fully extended) by the upward urging of the nitrogen gas cylinders 35. Instead of the nitrogen gas cylinders 35, an elastic member by which the rod 35*a* is constantly urged upward, may be provided.

In this way, when the drag 31 on which the holder 40 is disposed around the punch 30 is fixed to the bolster of the pressing machine and the die 10 is fixed to the slide of the pressing machine, the first molding surfaces 13*a* of the die pieces 13 and the fourth molding surfaces 40*a* of the holder 40 face in the up-down direction, and the second molding surface 20*a* of the pad 20 and the third molding surface 30*a* of the punch 30 face in the up-down direction.

Manufacturing Method

When the hat-shaped cross-section component 80 is manufactured by the thus configured manufacturing apparatus 1, initially, the sheet workpiece 70 is mounted on the punch 30 and the holder 40, as shown in FIG. 2. More specifically, the top forming part 71 in the workpiece 70 is mounted on the third molding surface 30*a*, and the flange forming parts 75 in the workpiece 70 are mounted on the fourth molding surfaces 40*a*. In this state, no force pushing the holder 40 downward is applied, and the rods 35*a* are fully extended, so the third molding surface 30*a* and the fourth molding surfaces 40*a* are flush with each other (workpiece mounting step).

Figure 3:
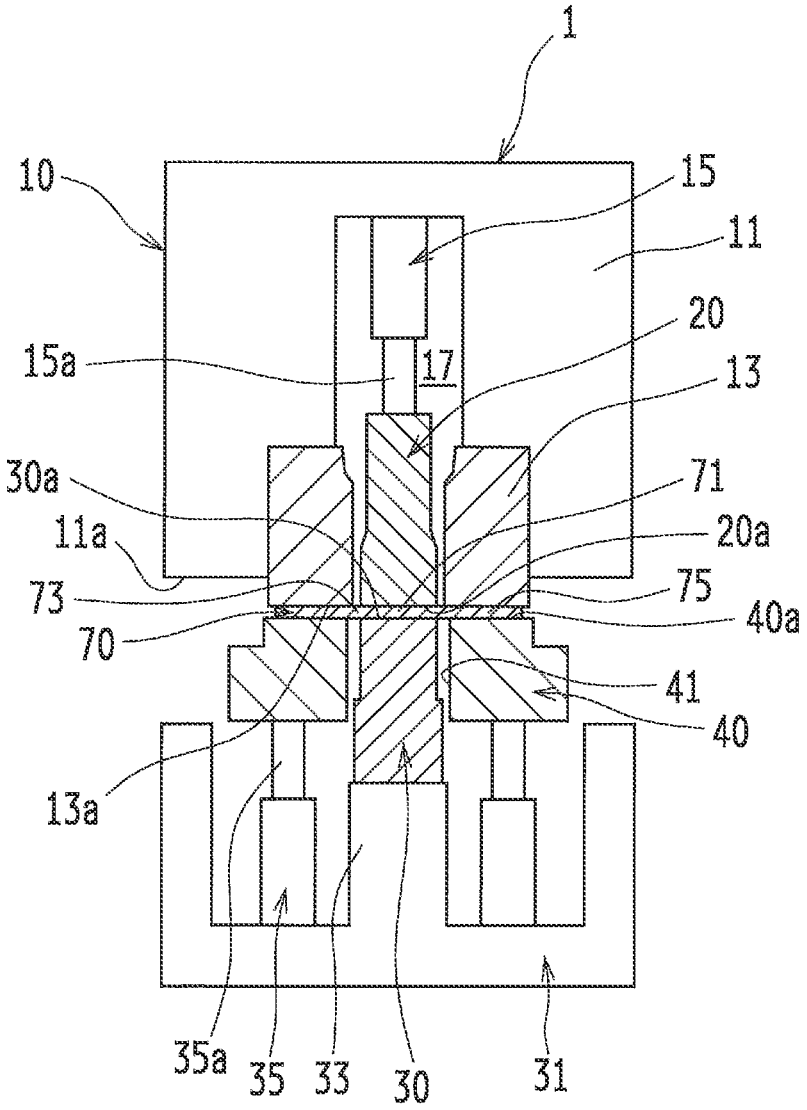
FIG. 3 is a cross-sectional view that schematically illustrates manufacturing step 2 for a hat-shaped cross-section component.
Figure 4:
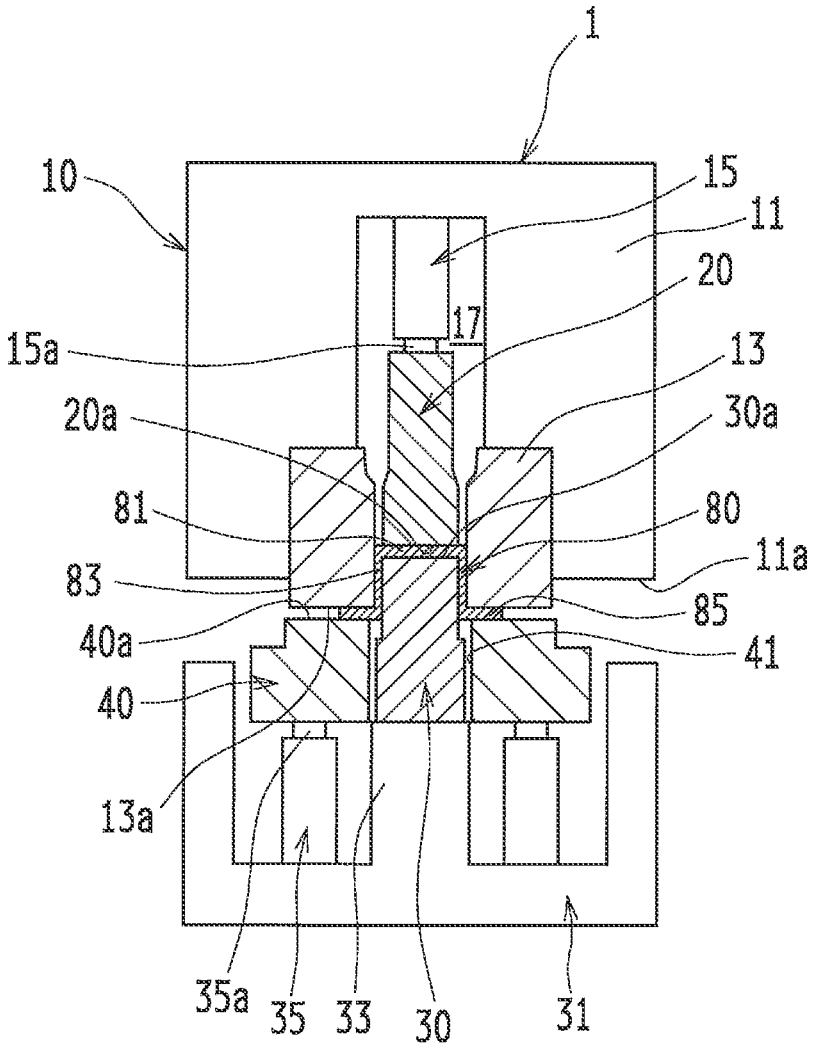
FIG. 4 is a cross-sectional view that schematically illustrates manufacturing step 3 for a hat-shaped cross-section component.

Subsequently, when the die 10 is lowered by driving the slide of the pressing machine, the top forming part 71 is sandwiched in the up-down direction by the second molding surface 20*a* and the third molding surface 30*a*, and the flange forming parts 75 are sandwiched in the up-down direction by the first molding surfaces 13*a* and the fourth molding surfaces 40*a*, as shown in FIG. 3. From this state, the pad 20 and the punch 30 sandwiching the top forming part 71 in the up-down direction and the die 10 and the holder 40 sandwiching the flange forming parts 75 are relatively moved in the up-down direction by further lowering the die 10. Specifically, when the die 10 is further lowered, the holder 40 pushed downward by the die pieces 13 moves downward against the urging force of the nitrogen gas cylinders 35, and the pad 20 pushed relatively upward by the punch 30 relatively moves upward so as to be pushed into the opening 17 against the urging force of the nitrogen gas cylinders 15, as shown in FIG. 4. When the punch 30 enters into the opening 17 while pushing the pad 20 in this way, the hat-shaped cross-section component 80 having the top forming part 71 as the top 81, the flange forming parts 75 as the flanges 85, and parts 73 each formed between the parts 71, 75 as the upright walls 83 is molded (mold clamping step).

Figure 5:
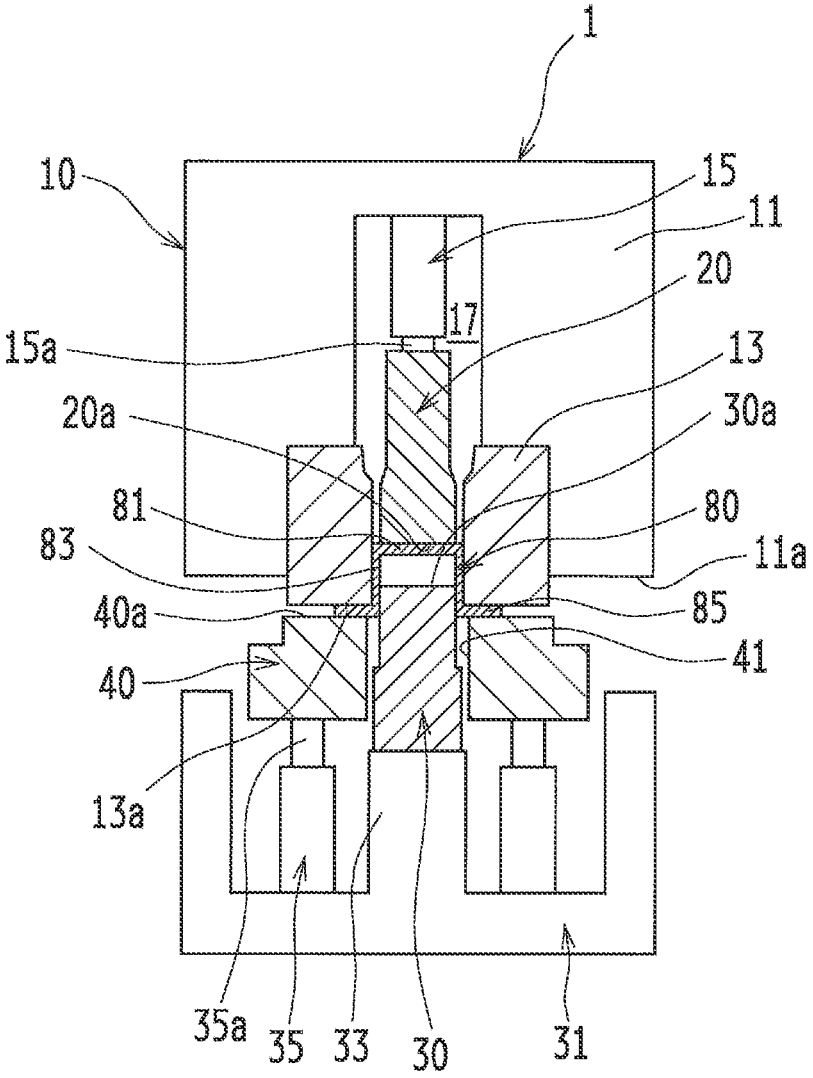
FIG. 5 is a cross-sectional view that schematically illustrates manufacturing step 4 for a hat-shaped cross-section component.
Figure 6:
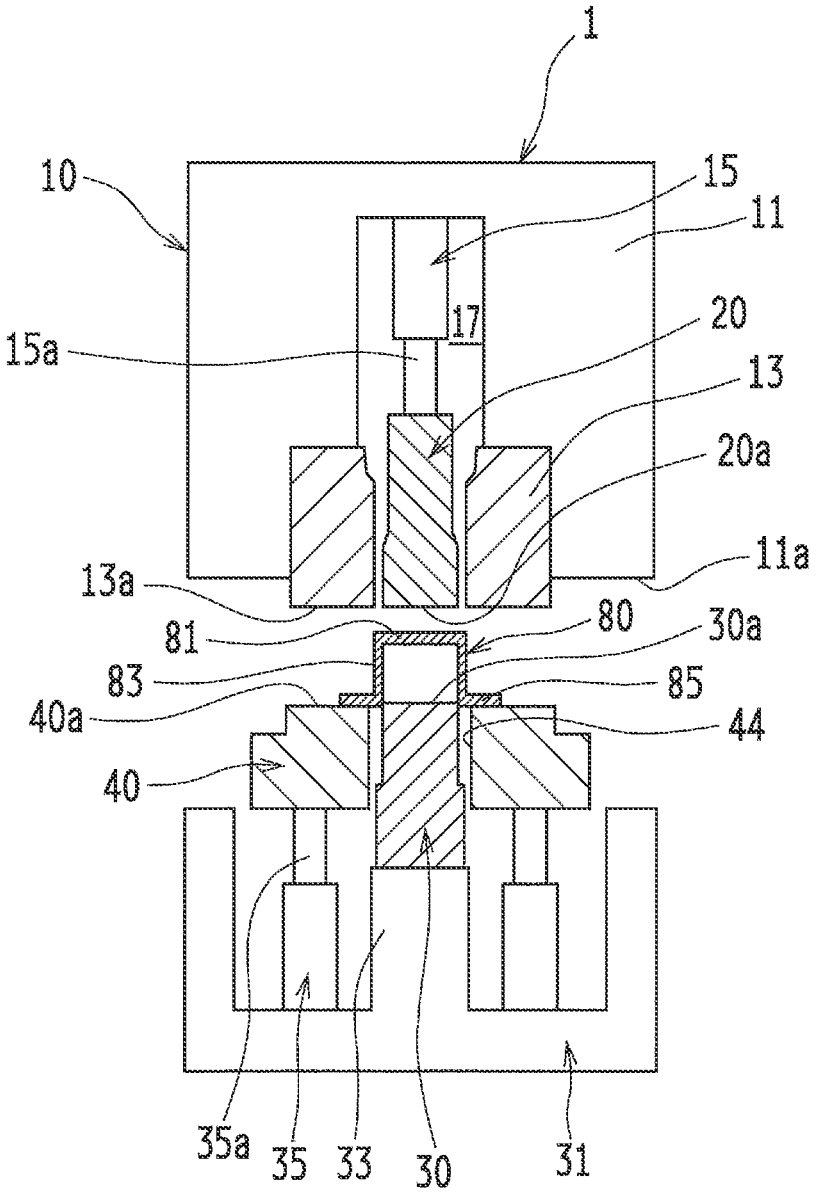
FIG. 6 is a cross-sectional view that schematically illustrates manufacturing step 5 for a hat-shaped cross-section component.

Subsequently, when the die 10 is raised by driving the slide of the pressing machine, the punch 30 leaves from the lower surface of the top 81 and moves out from the opening 17 of the die 10 while the second molding surface 20*a* is in contact with the top 81, and the holder 40 is raised by the urging force of the nitrogen gas cylinders 35 while the flanges 85 are sandwiched by the holder 40 and the first molding surfaces 13*a*, as shown in FIG. 5. Then, when the holder 40 is raised the most, that is, when the fourth molding surfaces 40*a* of the holder 40 are flush with the third molding surface 30*a* of the punch 30, the second molding surface 20*a* of the pad 20 leaves from the upper surface of the top 81, and removal of the hat-shaped cross-section component 80 completes, as shown in FIG. 6 (mold opening step).

First Restraint Portion

Figure 17:
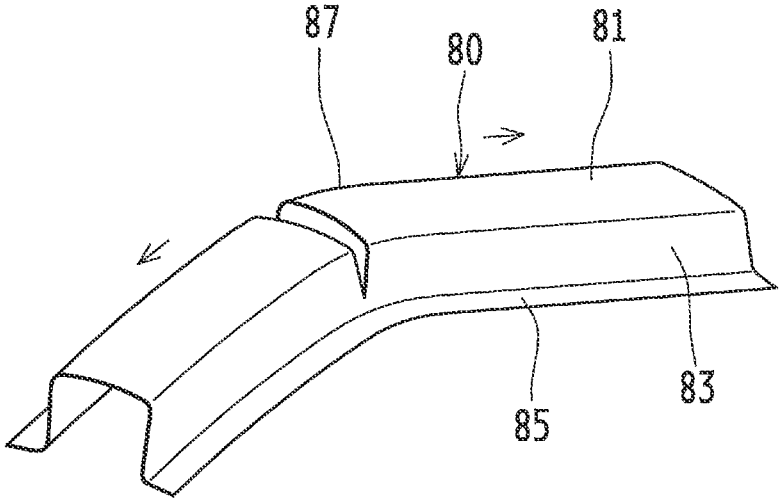
FIG. 17 is a view that schematically illustrates the mechanism that a crack occurs in a top.

Incidentally, when the hat-shaped cross-section component 80 having the convex curve 87 is manufactured, it is known that a crack occurs in the top 81 in the stretch flange forming (forming the upright wall 83 between the top 81 and each flange 85) process if the top forming part 71 is not held with the pad 20. More specifically, if there is no restraining force of the pad 20 (hereinafter, also referred to as "pad restraining force") that prevents displacement (slide) of the top forming part 71 in the longitudinal direction relative to the second and third molding surfaces 20*a*, 30*a*, displacement of the top forming part 71 occurs in the longitudinal direction as indicated by the arrows in FIG. 17, and a crack occurs in the top 81 at the convex curve 87 where displacement is large. It is also known that the pad restraining force for suppressing occurrence of a crack in the top 81 in the stretch flange forming process increases in proportion to the strength and thickness of the raw material of the workpiece 70.

For these reasons, when the hat-shaped cross-section component 80 having the convex curve 87 and made of a high-tensile material is manufactured as in the case of the present embodiment, a relatively large pad restraining force is required to suppress occurrence of a crack in the top 81, and a relatively large pressing force of the pad 20, that is, a relatively large urging force of the nitrogen gas cylinders 15, is required to realize such a pad restraining force.

Figure 18:
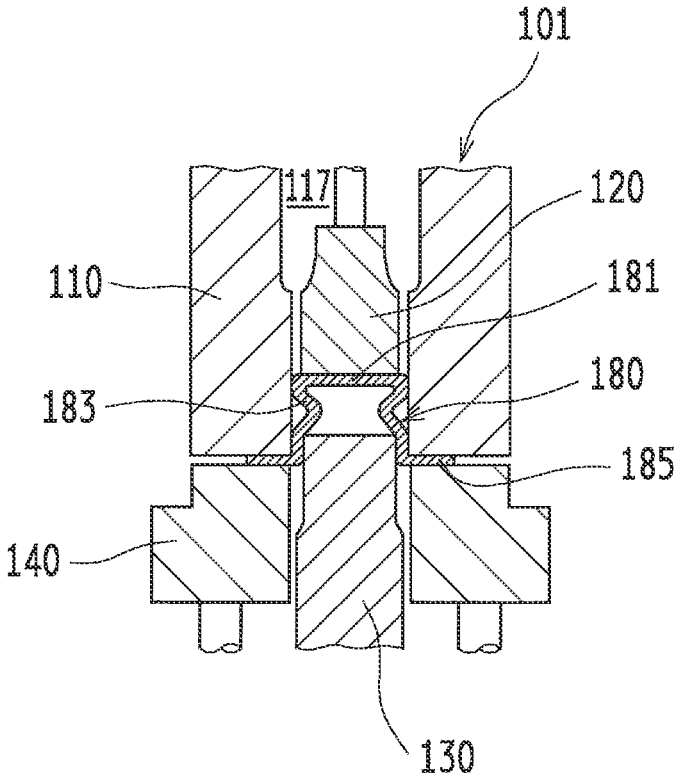
FIG. 18 RELATED ART
FIG. 18 is a cross-sectional view that schematically illustrates an existing manufacturing apparatus.

FIG. 18 is a cross-sectional view that schematically illustrates an existing manufacturing apparatus 101. The existing manufacturing apparatus 101 is similar to the manufacturing apparatus 1 of the present embodiment in that, as shown in FIG. 18, a hat-shaped cross-section component 180 is formed by relatively moving in an up-down direction a pad 120 and a punch 130 sandwiching a top forming part of a workpiece in the up-down direction and a die 110 and a holder 140 sandwiching flange forming parts of the workpiece in the up-down direction.

However, when the hat-shaped cross-section component 180 having a convex curve and made of a high-tensile material is manufactured by the existing manufacturing apparatus 101, there is the following inconvenience. At the time of mold release (at the time of mold opening), when the die 110 is moved upward, the punch 130 moves out from an opening 117 of the die 110, and, at the same time, the pad 120 moves downward by an urging force inside the opening 117 of the die 110, while the holder 140 relatively moves upward by an urging force around the punch 130. Then, the punch 130 leaves from the lower surface of a top 181, a relatively large pressing force of the pad 120, which generates a pad restraining force for suppressing displacement of the top forming part in the longitudinal direction, acts from the upper side on the top 181 that has lost a support from the lower side by the punch 130, and the pressing force of the holder 140 acts from the lower side on the flanges 185. Therefore, the hat-shaped cross-section component 180 is compressed by the pressing forces of the pad 120 and the holder 140 from both sides in the up-down direction, so, as shown in FIG. 18, there are concerns that the hat-shaped cross-section component 180 deforms in such a mode that the upright walls 183 buckle.

To suppress such a deformation of the hat-shaped cross-section component 180, a technique for providing a limiting portion for limiting a pressing force by restricting the movement of the holder 140 relative to the punch 130 or the movement of the pad 120 relative to the die 110 inside the manufacturing apparatus 101 is conceivable. However, with such a technique, there is inconvenience that extensive processing equipment, or the like, is required, and a metal mold structure is complicated, so manufacturing cost increases.

The manufacturing apparatus 1 according to the present embodiment makes it difficult for the workpiece 70 in itself to deform in the longitudinal direction with a characteristic shape of a metal mold. Specifically, the manufacturing apparatus 1 of the present embodiment includes a first restraint portion 50 for suppressing displacement of the top forming part 71 in the longitudinal direction relative to the second and third molding surfaces 20*a*, 30*a* during a period from when the top forming part 71 is sandwiched by the second molding surface 20*a* and the third molding surface 30*a* to when the upright walls 83 are molded.

Figure 7:
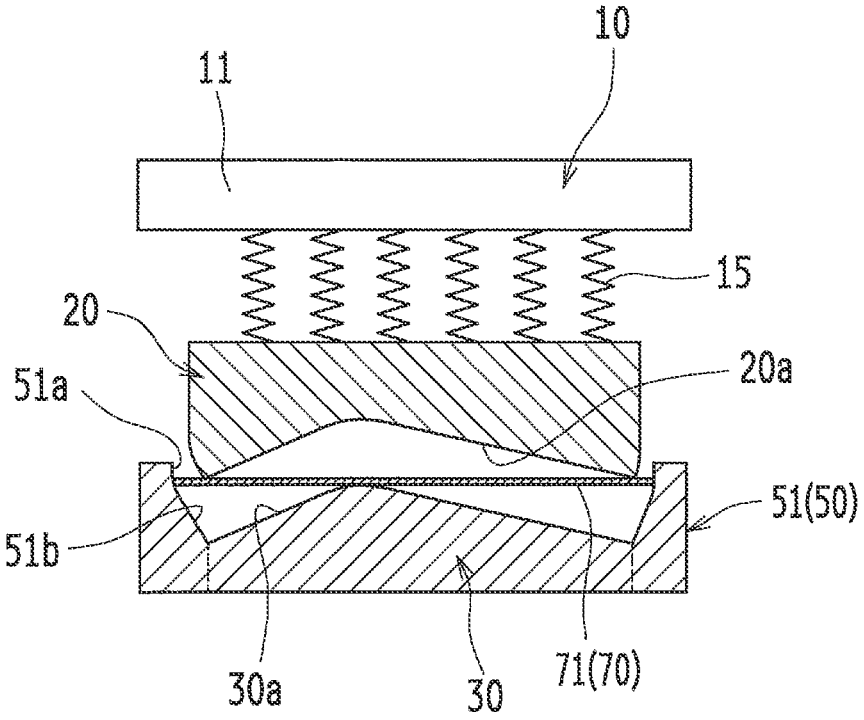
FIG. 7 is a longitudinal sectional view that schematically illustrates a first restraint portion.
Figure 8:
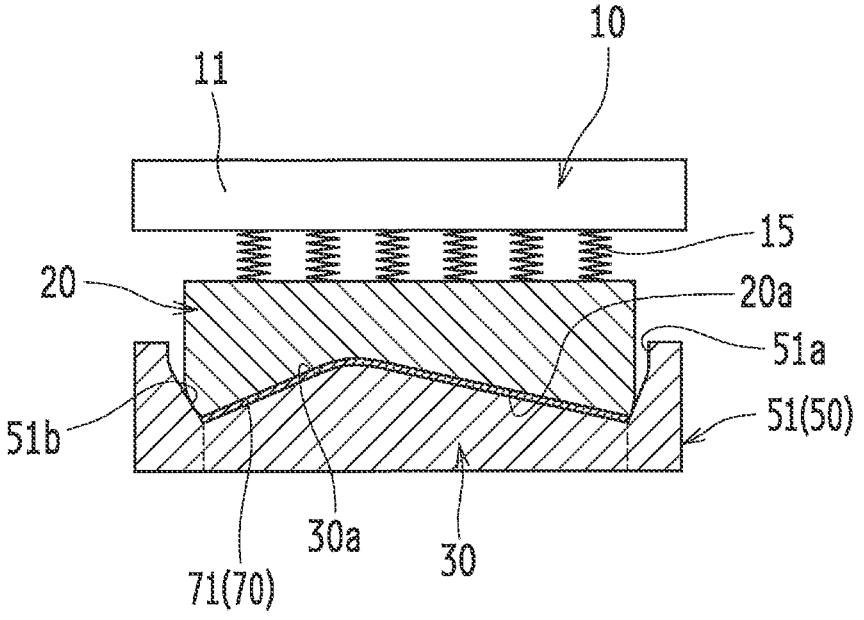
FIG. 8 is a longitudinal sectional view that schematically illustrates the first restraint portion.

FIG. 7 and FIG. 8 are longitudinal sectional views that schematically illustrate the first restraint portion 50 according to the present embodiment. In the present embodiment, as shown in FIG. 7 and FIG. 8, a pair of contact portions 51 provided on both outer sides of the third molding surface 30*a* in the longitudinal direction in the punch 30 so as to come into contact with both ends of the top forming part 71 in the longitudinal direction is employed as the first restraint portion 50 for suppressing displacement of the top forming part 71 in the longitudinal direction relative to the second and third molding surfaces 20*a*, 30*a*.

The contact portions 51 are part of the punch 30 and are provided at both end portions of the punch 30 in the longitudinal direction. Inner surfaces of contact portions 51 in the longitudinal direction (facing surfaces of the contact portions 51) each are made up of a vertical surface 51*a* provided on the upper side and an inclined surface 51*b* provided on the lower side so as to extend such that an inward inclination in the longitudinal direction increases toward the lower side. A distance between the vertical surfaces 51*a* in the contact portions 51 is set so as to be slightly longer than the length of the workpiece 70 in the longitudinal direction, while lower ends of the inclined surfaces 51*b* in the contact portions 51 coincide with both ends of the third molding surface 30*a* in the longitudinal direction.

In the case where the hat-shaped cross-section component 80 is manufactured by the thus configured manufacturing apparatus 1, initially, as shown in FIG. 7, the sheet workpiece 70 is passed between the vertical surfaces 51*a* between which the distance is slightly longer than the length of the workpiece 70 in the longitudinal direction, the top forming part 71 is mounted on the third molding surface 30*a*, and the flange forming parts 75 not shown in FIG. 7 are mounted on the fourth molding surfaces 40*a*.

Subsequently, when the die 10 is lowered by driving the slide of the pressing machine, the top forming part 71 is sandwiched in the up-down direction by the second molding surface 20*a* and the third molding surface 30*a* as shown in FIG. 8, and the flange forming parts 75 are sandwiched in the up-down direction by the first molding surfaces 13*a* and the fourth molding surfaces 40*a* not shown in FIG. 8. At this time, both ends of the top forming part 71 in the longitudinal direction come into contact with the lower ends of the inclined surfaces 51*b* in the contact portions 51, and the top forming part 71 is restrained in the longitudinal direction.

From this state, the pad 20 and the punch 30 sandwiching the top forming part 71 in the up-down direction and the die 10 and the holder 40 sandwiching the flange forming parts 75 are relatively moved in the up-down direction by further lowering the die 10. Thus, the hat-shaped cross-section component 80 is molded. During then, by bringing both ends of the top forming part 71 into contact with the lower ends of the inclined surfaces 51*b* of the contact portions 51, the second and third molding surfaces 20*a*, 30*a* and the first and fourth molding surfaces 13*a*, 40*a* are relatively moved in the up-down direction while displacement of the top forming part 71 in the longitudinal direction relative to the second and third molding surfaces 20*a*, 30*a* is suppressed.

In this way, in the present embodiment, during the period from when the top forming part 71 is sandwiched by the second molding surface 20*a* and the third molding surface 30*a* to when the upright walls 83 are molded, in other words, in the stretch flange forming process, even when the pressing force of the pad 20, that is, the urging force of the nitrogen gas cylinders 15, is relatively reduced, occurrence of a crack in the top 81 is suppressed in the stretch flange forming process because the contact portions 51 for suppressing displacement of the top forming part 71 in the longitudinal direction relative to the second and third molding surfaces 20*a*, 30*a* are provided.

In addition, both ends of the top forming part 71 in the longitudinal direction come into contact with the contact portions 51, in other words, both ends of the top forming part 71 in the longitudinal direction are restrained, so there is no room for the top forming part 71 to extend in the longitudinal direction in the stretch flange forming process. As a result, no displacement of the top forming part 71 in the longitudinal direction relative to the second and third molding surfaces 20*a*, 30*a* occurs. Therefore, only when the top 81 having the convex curve 87 can be molded while the sheet workpiece 70 is sandwiched by the second molding surface 20*a* and the third molding surface 30*a*, a pad restraining force can be reduced from the viewpoint of suppressing displacement of the top forming part 71 in the longitudinal direction.

Hence, the pressing force of the pad 20 based on the urging force of the nitrogen gas cylinders 15, which acts on the top 81 from the upper side during mold release, can be relatively reduced, so a deformation of the hat-shaped cross-section component 80 is suppressed during mold release with such a simple configuration that the punch 30 has the contact portions 51.

First Modification

The present modification differs from the first embodiment in that displacement of the top forming part 71 in the longitudinal direction relative to the second and third molding surfaces 20*a*, 30*a* is suppressed by increasing a frictional force between the second molding surface 20*a* and the top forming part 71. Hereinafter, the difference from the first embodiment will be mainly described.

Figure 9:
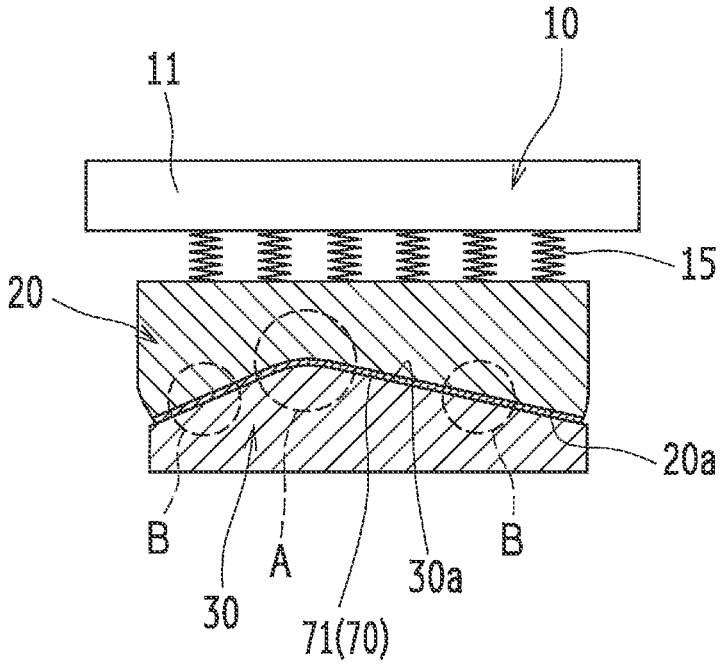
FIG. 9 is a longitudinal sectional view that schematically illustrates a first restraint portion according to a first modification.
Figure 10:
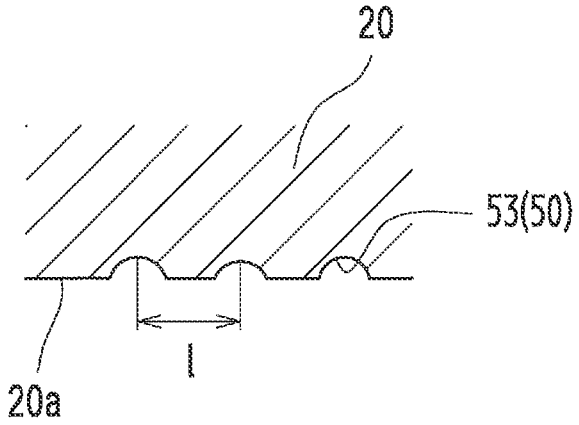
FIG. 10 is a partially enlarged view of portion A or portion B in FIG. 9.

FIG. 9 is a longitudinal sectional view that schematically illustrates a first restraint portion 50 according to the present modification. FIG. 10 is a partially enlarged view of portion A or portion B in FIG. 9. In the present modification, as shown in FIG. 9 and FIG. 10, a ragged portion 53 provided on the second molding surface 20*a* is employed as the first restraint portion 50 for suppressing displacement of the top forming part 71 in the longitudinal direction relative to the second and third molding surfaces 20*a*, 30*a*.

For example, as shown in FIG. 10, grooves having a semicircular cross section, provided on the second molding surface 20*a* and extending in the width direction, may be employed as the ragged portion 53. The range in which the ragged portion 53 is provided may be a curved part corresponding to the convex curve 87 on the second molding surface 20*a*, at which displacement in the longitudinal direction would be the largest as shown at portion A in FIG. 9, may be a flat part that sandwiches the part corresponding to the convex curve 87 on the second molding surface 20*a* as shown at portion B in FIG. 9, or may be the entire second molding surface 20*a*.

When the grooves having a semicircular cross section with a radius of 1 mm were provided at an interval 1 of 2 mm on the flat part that sandwiches the part corresponding to the convex curve 87 on the second molding surface 20*a* in the longitudinal direction as shown at portion B in FIG. 9, it was found through the experiment that the coefficient of friction between the second molding surface 20*a* and the top forming part 71 was about twice as large as that when no grooves were provided.

In the case where the hat-shaped cross-section component 80 is manufactured by the thus configured manufacturing apparatus 1, when the top forming part 71 is sandwiched in the up-down direction by the second molding surface 20*a* and the third molding surface 30*a* as shown in FIG. 9, the surface of the top forming part 71 is engaged with the ragged portion 53 provided on the second molding surface 20*a*, so displacement of the top forming part 71 in the longitudinal direction relative to the second and third molding surfaces 20*a*, 30*a* is suppressed.

In this way, when the surface of the top forming part 71 is engaged with the ragged portion 53 provided on the second molding surface 20*a*, the coefficient of friction between the second molding surface 20*a* and the top forming part 71 is increased. Therefore, even when the pad restraining force is not relatively increased, displacement of the top forming part 71 in the longitudinal direction is suppressed, with the result that occurrence of a crack in the top 81 is suppressed. Thus, the pad restraining force, that is, the urging force of the nitrogen gas cylinders 15, can be relatively reduced. Hence, with such a simple configuration that the ragged portion 53 is provided on the second molding surface 20*a*, a deformation of the hat-shaped cross-section component 80 is suppressed during mold release.

Second Modification

The present modification differs from the first embodiment in that displacement of the top forming part 71 in the longitudinal direction relative to the second and third molding surfaces 20*a*, 30*a* is suppressed by increasing an engaging force between the second and third molding surfaces 20*a*, 30*a* and the top forming part 71. Hereinafter, the difference from the first embodiment will be mainly described.

Figure 11:
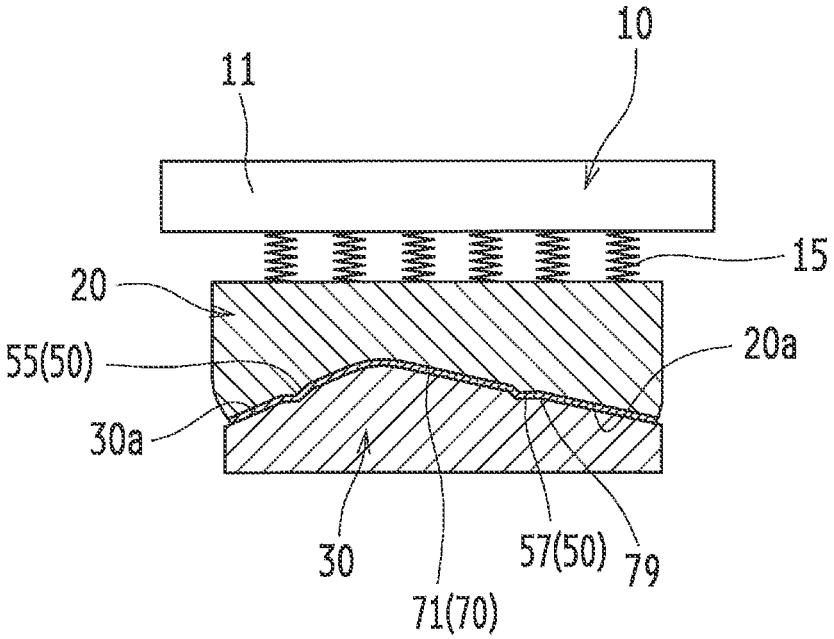
FIG. 11 is a longitudinal sectional view that schematically illustrates a first restraint portion according to a second modification.

FIG. 11 is a longitudinal sectional view that schematically illustrates a first restraint portion 50 according to the present modification. In the present modification, as shown in FIG. 11, engaging portions 55, 57 respectively provided on the second and third molding surfaces 20*a*, 30*a* are employed so as to engage with an uneven portion 79 provided in the top forming part 71 as the first restraint portion 50 for suppressing displacement of the top forming part 71 in the longitudinal direction relative to the second and third molding surfaces 20*a*, 30*a*.

A manufacturing method according to the present modification includes, before the mold clamping step, specifically, as a step previous to the main step (the workpiece mounting step, the mold clamping step, and the mold opening step), a preparation step of providing the uneven portion 79 in at least part of the top forming part 71 in the workpiece 70. The uneven portion 79 may be a bend, a ragged portion, or the like, other than a step provided in the top forming part 71, as shown in FIG. 11.

On the other hand, an upper engaging portion 55 that matches the shape of the uneven portion 79 is provided on the second molding surface 20*a* of the pad 20, and a lower engaging portion 57 that matches the shape of the uneven portion 79 is provided on the third molding surface 30*a* of the punch 30. When the top forming part 71 is sandwiched by the second molding surface 20*a* and the third molding surface 30*a*, the upper and lower engaging portions 55, 57 mesh with (engage with) the uneven portion 79.

In the case where the hat-shaped cross-section component 80 is manufactured by the thus configured manufacturing apparatus 1, when the top forming part 71 is sandwiched in the up-down direction by the second molding surface 20*a* and the third molding surface 30*a* as shown in FIG. 11, the upper and lower engaging portions 55, 57 provided on the second and third molding surfaces 20*a*, 30*a* engage with the uneven portion 79, with the result that displacement of the top forming part 71 in the longitudinal direction relative to the second and third molding surfaces 20*a*, 30*a* is suppressed.

In this way, when the upper and lower engaging portions 55, 57 engage with the uneven portion 79, occurrence of a crack in the top 81 is suppressed by suppressing displacement of the top forming part 71 in the longitudinal direction even when the pad restraining force is not relatively increased. Thus, the urging force of the nitrogen gas cylinders 15 can be relatively reduced. Therefore, with such a simple configuration that the upper and lower engaging portions 55, 57 are provided on the second and third molding surfaces 20*a*, 30*a*, a deformation of the hat-shaped cross-section component 80 is suppressed during mold release.

Second Embodiment

The present embodiment differs from the first embodiment in that a deformation of the hat-shaped cross-section component 80 is not suppressed during mold release by relatively reducing the pressing force of the pad 20 but the hat-shaped cross-section component 80 in itself is made difficult to deform. Hereinafter, the difference from the first embodiment will be mainly described.

Figure 12:
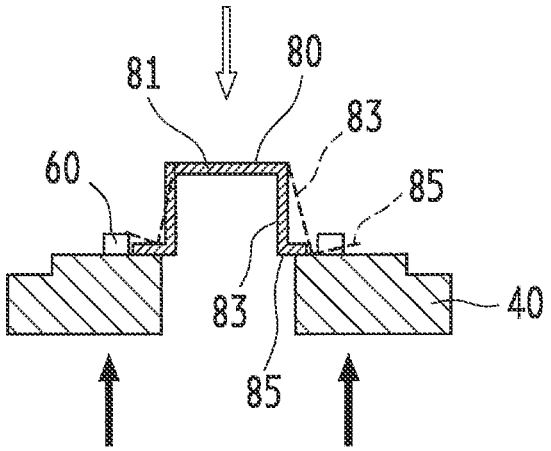
FIG. 12 is a view that schematically illustrates the principle of suppressing a deformation of a hat-shaped cross-section component according to a second embodiment.

FIG. 12 is a view that schematically illustrates the principle of suppressing a deformation of the hat-shaped cross-section component 80 according to the present embodiment. For example, even during mold release but when the upright walls 83 are maintained straight, in other words, when only an axial force acts on the upright walls 83, a large pressing force can be supported by the upright walls 83 to some extent.

When the hat-shaped cross-section component 80 is compressed in the up-down direction by the pressing forces of the pad 20 and the holder 40 during mold release (see the outline arrow and the solid arrows in FIG. 12), the upright walls 83 and the flanges 85 spread in the width direction as represented by the dashed line in FIG. 12, and a warpage (curve) easily occurs. As a result, when the hat-shaped cross-section component 80 having the convex curve 87 and made of a high-tensile material is manufactured, the hat-shaped cross-section component 80 deforms in such a mode that the upright walls 83 buckle by a relatively large pressing force of the pad 20.

For this reason, as shown in FIG. 12, if parts 60 that suppress spreading of the upright walls 83 and the flanges 85 in the width direction are provided, the upright walls 83 are maintained straight, so a deformation of the hat-shaped cross-section component 80 should be suppressed during mold release.

The manufacturing apparatus 1 of the present embodiment includes a second restraint portion 60 for suppressing spreading of the upright walls 83 and the flanges 85 in the width direction during a period until the die 10 and the holder 40 sandwiching the flanges 85 are moved upward to be released while the second molding surface 20*a* is in contact with the top 81 in the mold opening step.

Figure 13:
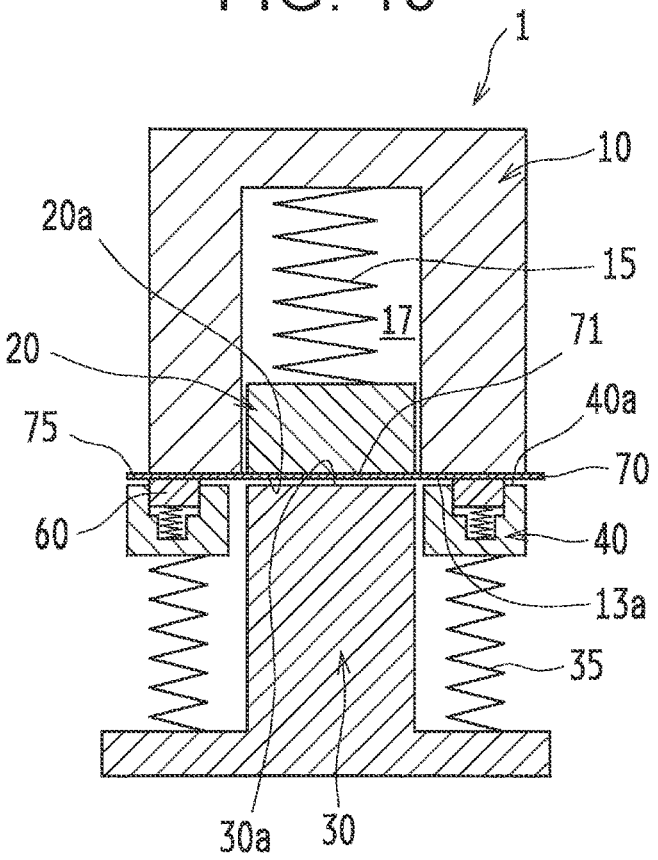
FIG. 13 is a cross-sectional view that schematically illustrates manufacturing step 1 for a hat-shaped cross-section component.
Figure 14:
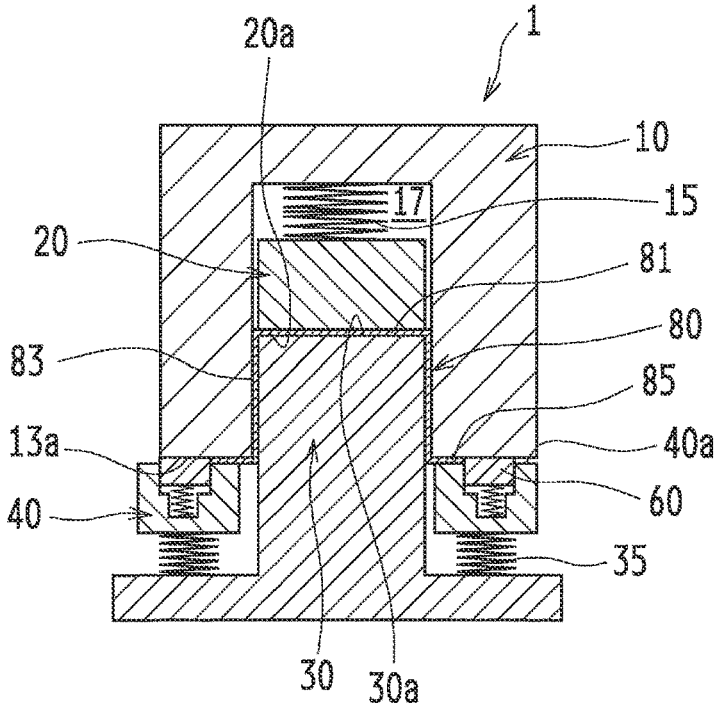
FIG. 14 is a cross-sectional view that schematically illustrates manufacturing step 2 for a hat-shaped cross-section component.
Figure 15:
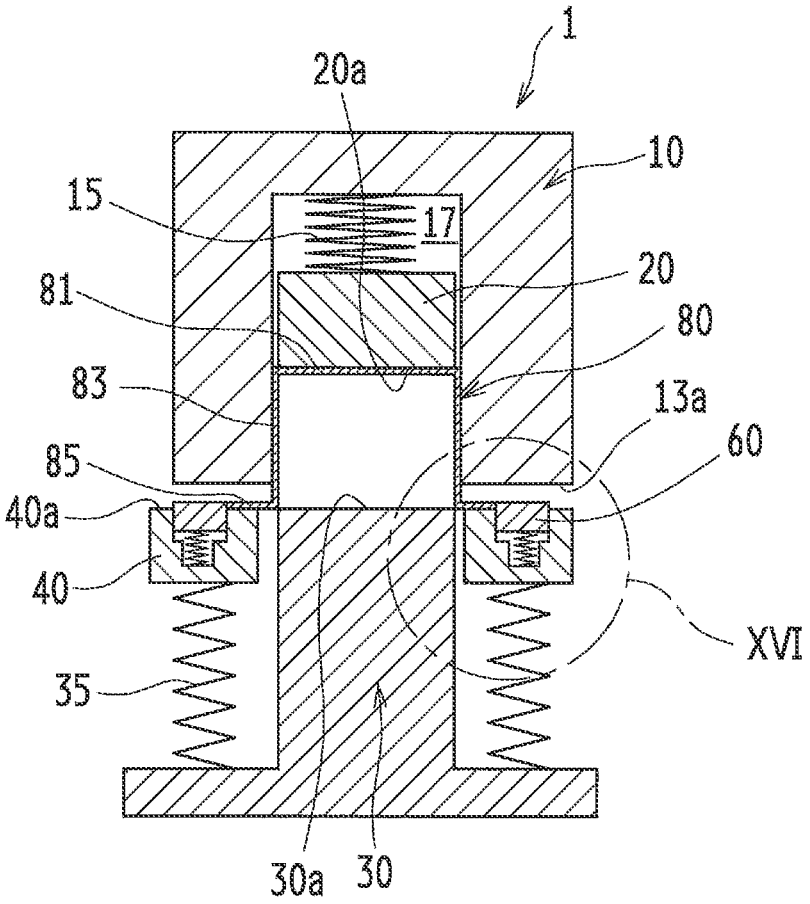
FIG. 15 is a cross-sectional view that schematically illustrates manufacturing step 3 for a hat-shaped cross-section component.
Figure 16:
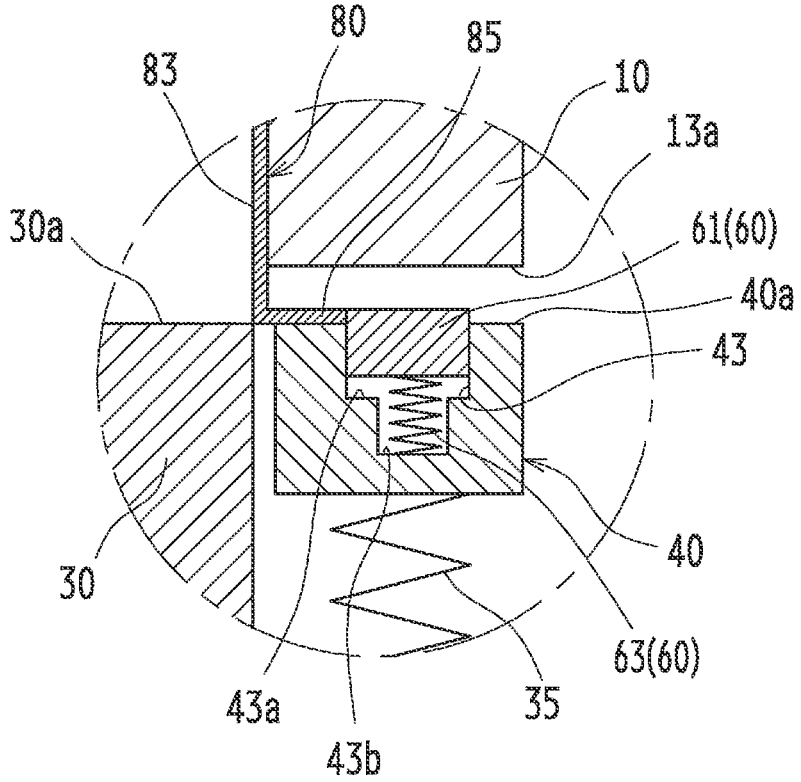
FIG. 16 is a partially enlarged view of FIG. 15.

FIG. 13 to FIG. 15 are cross-sectional views that schematically illustrate manufacturing steps 1 to 3 for the hat-shaped cross-section component 80, respectively. FIG. 16 is a partially enlarged view of FIG. 15. In FIG. 13 to FIG. 15, for the sake of visualization, the manufacturing apparatus 1 is simplified as compared to FIG. 2 to FIG. 6. In the present embodiment, as shown in FIG. 13 to FIG. 15, contact members 61 projecting upward by the thickness of the flanges 85 from the fourth molding surfaces 40*a* and coming into contact with both end portions of the flanges 85 in the width direction are employed as the second restraint portion 60 for suppressing spreading of the upright walls 83 and the flanges 85 in the width direction.

More specifically, as shown in FIG. 16, a recessed groove 43 that extends in the longitudinal direction and that is open upward is provided on each of the fourth molding surfaces 40*a* of the holder 40. A step surface 43*a* is provided in the recessed groove 43 at a level higher than its bottom surface 43*b*. An urging device 63 made up of, for example, a spring is fixed to the bottom surface 43*b* of the recessed groove 43. The contact members 61 have a rectangular rod shape extending in the longitudinal direction. The contact members 61 each are provided on the holder 40 so as to be movable downward and fitted to the recessed groove 43 against an upward urging force of the urging device 63 from a position in which the contact member 61 projects upward by the thickness of the flanges 85 from the fourth molding surface 40*a*.

When the hat-shaped cross-section component 80 is manufactured by the thus configured manufacturing apparatus 1, initially, the flange forming parts 75 are mounted on the upper surfaces of the contact members 61 projecting upward from the fourth molding surfaces 40*a*, as shown in FIG. 13. At this time, the top forming part 71 is located above the third molding surface 30*a* substantially flush with the fourth molding surfaces 40*a*.

Subsequently, when the die 10 is lowered by driving the slide of the pressing machine, the top forming part 71 is sandwiched in the up-down direction by the second molding surface 20*a* and the third molding surface 30*a*, and the flange forming parts 75 are sandwiched in the up-down direction by the first molding surfaces 13*a* and the contact members 61. When the die 10 is further lowered from this state, the pad 20 pushed relatively upward by the punch 30 relatively moves upward so as to be pushed into the opening 17, as shown in FIG. 14. At this time, because the force of the first molding surfaces 13*a* pushing the flange forming parts 75 downward is absorbed by the urging devices 63 via the contact members 61, the force for sandwiching the flange forming parts 75 in the up-down direction by the first molding surfaces 13*a* and upper surfaces of the contact members 61 is relatively small, so the flange forming parts 75 slide inward in the width direction on the upper surfaces of the contact members 61 as the pad 20 is pushed into the opening 17.

Then, when both ends of the flange forming parts 75 in the width direction reach the inner sides of the contact members 61 in the width direction, the flange forming parts 75 are sandwiched by the first molding surfaces 13*a* and the fourth molding surfaces 40*a*, as shown in FIG. 14. When the contact members 61 are pushed downward by the first molding surfaces 13*a*, the contact members 61 lower unless the contact members 61 come into contact with the step surfaces 43*a*. Therefore, as in the case where such contact members 61 are not provided, the flange forming parts 75 can be firmly sandwiched by the first molding surfaces 13*a* and the fourth molding surfaces 40*a*.

From this state, when the pad 20 and the punch 30 sandwiching the top forming part 71 in the up-down direction and the die 10 and the holder 40 sandwiching the flange forming parts 75 are relatively moved in the up-down direction by further lowering the die 10, the upright wall 83 is formed between the top 81 and each flange 85 (mold clamping step).

After the mold clamping step, while the second molding surface 20*a* is in contact with the top 81, the die 10 and the holder 40 sandwiching the flanges 85 are moved upward to be released (mold opening step). At this time, as shown in FIG. 15, both end portions of the flanges 85 in the width direction come into contact with the contact members 61 projecting from the fourth molding surfaces 40*a* by the thickness of the flanges 85, so spreading of the upright walls 83 and the flanges 85 in the width direction is suppressed.

In this way, spreading of the upright walls 83 and the flanges 85 in the width direction is suppressed by the contact members 61 that serve as the second restraint portion 60, so the hat-shaped cross section is maintained, in other words, the upright walls 83 are maintained straight. Therefore, a warpage (curve) is made difficult to occur. Thus, even when the pressing force of the pad 20, which generates such a restraining force for suppressing displacement of the top forming part 71 in the longitudinal direction, acts on the top 81 from the upper side during mold release, a deformation of the hat-shaped cross-section component 80 is suppressed with such a simple configuration that spreading of the upright walls 83 and the flanges 85 in the width direction is suppressed by the contact members 61.

Other Embodiments

The disclosure is not limited to the above-described embodiments and may be implemented in other various forms without departing from its spirit or main features.

In the first modification of the first embodiment, the ragged portion 53 is provided on the second molding surface 20*a* as the first restraint portion 50; however, the configuration is not limited thereto. For example, the ragged portion 53 may be provided on the third molding surface 30*a*, or the ragged portion 53 may be provided on each of the second and third molding surfaces 20*a*, 30*a*.

In the second modification of the first embodiment, the uneven portion 79 is provided in the top forming part 71 of the workpiece 70 in the preparation step; however, the configuration is not limited thereto. For example, when the top forming part 71 is sandwiched by the second molding surface 20*a* and the third molding surface 30*a* in the main step, the uneven portion 79 that engages with the upper and lower engaging portions 55, 57 may be provided by pressing the top forming part 71 with the upper and lower engaging portions 55, 57.

In the second embodiment, the contact members 61 projecting upward by the thickness of the flanges 85 from the fourth molding surfaces 40*a* are provided as the second restraint portion 60; however, the configuration is not limited thereto. For example, contact members projecting downward by the thickness of the flanges 85 from the first molding surfaces 13*a* may be provided.

In the above-described embodiments, urging forces are applied to the pad 20 and the holder 40 with the nitrogen gas cylinders 15, 35; however, the configuration is not limited thereto. For example, urging forces may be applied to the pad 20 and the holder 40 with elastic members, such as springs (not shown), instead of gas cylinders.

In this way, the above-described embodiments are merely illustrative in all aspects and should not be interpreted restrictively. The disclosure also encompasses modifications and changes equivalent to the appended claims.

According to the disclosure, displacement of a hat-shaped cross-section component is suppressed during mold release with a simple configuration, so it is very useful in applications to a manufacturing apparatus and manufacturing method for a hat-shaped cross-section component.

What is claimed is:

1. A manufacturing apparatus for a hat-shaped cross-section component, the manufacturing apparatus comprising:

a die having first molding surfaces on both sides in a width direction of the manufacturing apparatus, the first molding surfaces being oriented in a first pressing direction, the die having an opening between the first molding surfaces, the opening being open in the first pressing direction;

a pad having a second molding surface oriented in the first pressing direction, the pad being provided in the die so as to be relatively movable in a second pressing direction and be pushed into the opening against an urging force in the first pressing direction from a position in which the second molding surface and the first molding surfaces are substantially even with each other;

a punch having a third molding surface oriented in the second pressing direction and facing the second molding surface;

a holder having fourth molding surfaces oriented in the second pressing direction and facing the first molding surfaces, the holder being provided around the punch so as to be movable in the first pressing direction against an urging force in the second pressing direction from a position in which the fourth molding surfaces and the third molding surface are substantially even with each other; and a first restraint portion, wherein:

the pad and the punch are configured to sandwich and press atop forming part in a sheet workpiece, the top forming part configured to be a top of the component after molding;

the die and the holder are configured to sandwich and press flange forming parts in the workpiece on both sides in a width direction of the top forming part, the flange forming parts configured to be flanges after molding:

the pad and the punch are configured to move in the second pressing direction relative to the die and the holder, or the die and the holder are configured to move in the first pressing direction relative to the pad and the punch to form an upright wall configured to be between the top and each flange; and the first restraint portion is configured to, during a period from when the top forming part is sandwiched by the second molding surface and the third molding surface to when the upright walls are molded, suppress displacement of the top forming part in a longitudinal direction of the top forming part relative to the second molding surface and the third molding surface, the first restraint portion being integrally formed with at least one of the second molding surface and the third molding surface.

2. The manufacturing apparatus according to claim 1, wherein the manufacturing apparatus includes a plurality of the first restraint portions, the first restraint portions being contact portions respectively integrally formed with both outer sides of the third molding surface in a longitudinal direction of the third molding surface in the punch, and the contact portions are configured to come into contact with both ends of the top forming part in a longitudinal direction of the top forming part.

3. The manufacturing apparatus according to claim 1, wherein the first restraint portion includes grooves integrally formed with at least one of the second molding surface and the third molding surface.

4. The manufacturing apparatus according to claim 1, wherein:

an uneven portion is provided in at least part of the top forming part; and the manufacturing apparatus includes a plurality of the first restraint portions, the first restraint portions being engaging portions integrally formed with the second molding surface and the third molding surface and configured to engage with the uneven portion.

5. The manufacturing apparatus according to claim 1, wherein the hat-shaped cross-section component has a convex curve curved in a longitudinal direction of the hat-shaped cross-section component and protruding in the second pressing direction.

6. The manufacturing apparatus according to claim 1, wherein the workpiece is made of a high-tensile steel.

7. A manufacturing method for a hat-shaped cross-section component in a manufacturing apparatus, the manufacturing apparatus including:

a die having first molding surfaces on both sides in a width direction of a top forming part in a sheet workpiece, the first molding surfaces being oriented in a first pressing direction, the top forming part being to be a top after molding, the die having an opening between the first molding surfaces, the opening being open in the first pressing direction;

a pad having a second molding surface oriented in the first pressing direction, the pad being provided in the die opening so as to be relatively movable in a second pressing direction and be pushed into the opening against an urging force in the first pressing direction from a position in which the second molding surface and the first molding surfaces are substantially even with each other;

a punch having a third molding surface oriented in the second pressing direction and facing the second molding surface:

a holder having fourth molding surfaces oriented in the second pressing direction and facing the first molding surfaces, the holder being provided around the punch so as to be movable in the first pressing direction against an urging force in the second pressing direction from a position in which the fourth molding surfaces and the third molding surface are substantially even with each other, the manufacturing method comprising:

a mold clamping step of molding an upright wall between the top and each of flanges by moving the second molding surface and the third molding surface, which sandwich and press the top forming part, in the second pressing direction relative to the first molding surfaces and the fourth molding surfaces, which sandwich and press flange forming parts to be the flanges after molding in the workpiece on both sides of the top forming part in the width direction of the top forming part, or moving the first molding surfaces and the fourth molding surfaces in the first pressing direction relative to the second molding surface and the third molding surface, wherein, in the mold clamping step, while displacement of the top forming part in a longitudinal direction of the top forming part relative to the second molding surface and the third molding surface is suppressed using a first restraint portion, the second molding surface and the third molding surface are relatively moved in the second pressing direction and the first molding surfaces and the fourth molding surfaces are relatively moved in the first pressing direction, the first restraint portion being integrally formed with at least one of the second molding surface and the third molding surface.

8. The manufacturing method according to claim 7, wherein, in the mold clamping step, both ends of the top forming part in the longitudinal direction are brought into contact with contact portions respectively integrally formed with both outer sides of the third molding surface in a longitudinal direction of the third molding surface in the punch.

9. The manufacturing method according to claim 7, wherein, in the mold clamping step, the top forming part is engaged with grooves integrally formed with at least one of the second molding surface and the third molding surface.

10. The manufacturing method according to claim 1, further comprising a preparation step of, before the mold clamping step, providing an uneven portion in at least part of the top forming part, wherein, in the mold clamping step, engaging portions integrally formed with the second molding surface and the third molding surface are engaged with the uneven portion.

11. The manufacturing method according to claim 7, wherein the hat-shaped cross-section component has a convex curve curved in a longitudinal direction of the hat-shaped cross-section component and protruding in the second pressing direction.

12. The manufacturing method according to claim 7, wherein the workpiece is made of a high-tensile steel.

* * * * *